US010563346B2

(12) United States Patent
Barre et al.

(10) Patent No.: US 10,563,346 B2
(45) Date of Patent: Feb. 18, 2020

(54) SHAPE SHIFTING HAMPER AND BAG

(71) Applicant: NEATFREAK GROUP INC., Mississauga (CA)

(72) Inventors: Bertrand Barre, Lapeyrouse (FR); Francis Lepage, Dommartin (FR); Yan Feng, Mississauga (CA)

(73) Assignee: NEATFREAK GROUP INC., Mississauga, Ontario (CA)

( * ) Notice: Subject to any disclaimer, the term of this patent is extended or adjusted under 35 U.S.C. 154(b) by 12 days.

(21) Appl. No.: 15/884,422

(22) Filed: Jan. 31, 2018

(65) Prior Publication Data

US 2018/0266046 A1 Sep. 20, 2018

Related U.S. Application Data

(60) Provisional application No. 62/471,495, filed on Mar. 15, 2017.

(51) Int. Cl.
*B65D 33/00* (2006.01)
*D06F 95/00* (2006.01)
(Continued)

(52) U.S. Cl.
CPC ..... *D06F 95/002* (2013.01); *A45C 3/00* (2013.01); *A45C 7/0059* (2013.01); *A45C 9/00* (2013.01);
(Continued)

(58) Field of Classification Search
CPC ... A45C 2009/007; A45C 9/00; A45C 7/0063; A45C 13/06; D06F 95/002; B65B 67/125; B65D 33/007; A45G 2003/008
See application file for complete search history.

(56) References Cited

U.S. PATENT DOCUMENTS 4,871,100 A 10/1989 Posner
5,178,273 A * 1/1993 Igarashi ..... A63B 55/57 206/315.7
(Continued)

FOREIGN PATENT DOCUMENTS

WO WO2014/068545 * 5/2014

OTHER PUBLICATIONS

Barre, Bertrand et al., co-pending Design U.S. Appl. No. 29/635,417 entitled "Garment Hamper", filed Jan. 31, 2018, having a common applicant, assignee and inventors with the present application.
(Continued)

*Primary Examiner* — Andrew T Kirsch
*Assistant Examiner* — Don M Anderson
(74) *Attorney, Agent, or Firm* — Patzik, Frank & Samotny Ltd.

(57) ABSTRACT

A container takes on the form of a laundry hamper or basket while static or stationary. Upon bringing front and back panels of the container into closer proximity for transport, such as by drawing together their respective handles, or drawing one of the handles towards the other, the container changes configuration, or shape, to that of a tote bag. Upon releasing at least one of the front and back panels of the container from being drawn towards the other, such as by releasing at least one of their respective handles, the container automatically reverts back to the form of a laundry hamper or basket. The use of substantially rigid front and back panels, coupled with side panels that have resilient upper regions, permit the side panels to take on a spout-like configuration when the container is in its tote bag configuration, and to return to a planar configuration when the container is in its laundry hamper or basket configuration.

17 Claims, 4 Drawing Sheets

(51) Int. Cl.

| | |
|---|---|
| ***A45C 7/00*** | (2006.01) |
| ***B65B 67/12*** | (2006.01) |
| ***A45C 9/00*** | (2006.01) |
| ***A45C 3/00*** | (2006.01) |
| ***A45C 13/04*** | (2006.01) |
| ***B65D 33/10*** | (2006.01) |
| ***B65D 33/02*** | (2006.01) |
| *B65D 30/00* | (2006.01) |

(52) U.S. Cl.
CPC ..... *A45C 13/04* (2013.01); *B65B 67/125* (2013.01); *B65D 33/007* (2013.01); *B65D 33/02* (2013.01); *B65D 33/10* (2013.01); *A45C 2003/008* (2013.01); *A45C 2009/007* (2013.01); *B65D 29/00* (2013.01)

(56) References Cited

U.S. PATENT DOCUMENTS

| | | | | |
|---|---|---|---|---|
| 5,205,610 | A * | 4/1993 | Reninger | A45C 9/00 297/17 |
| 2006/0169691 | A1* | 8/2006 | Rothschild | A45C 7/0054 220/7 |
| 2006/0201979 | A1 | 9/2006 | Achilles | |
| 2006/0231692 | A1* | 10/2006 | Sabounjian | A45C 7/0063 248/95 |
| 2009/0101253 | A1 | 4/2009 | Kinskey et al. | |
| 2013/0092686 | A1 | 4/2013 | Sabounjian | |

OTHER PUBLICATIONS

Office Action dated Jan. 2, 2019 in Canadian Patent Application No. 2,997,437, which claims priority to U.S. Appl. No. 15/844,422.

Notice of Allowance, dated Sep. 30, 2019 in connection with Canadian counterpart application No. 2,997,437 to U.S. Appl. No. 15/884,422.

* cited by examiner

SHAPE SHIFTING HAMPER AND BAG

CROSS REFERENCE TO RELATED APPLICATIONS

This application claims the benefit of U.S. provisional application Ser. No. 62/471,495, filed Mar. 15, 2017, the entirety of which is hereby incorporated by reference.

BACKGROUND OF THE INVENTION

1. Field of the Invention

The present invention relates, in general, to storage containers and, more particularly, to hampers, baskets and tote bags for storing and transporting garments and other items.

2. General Background of the Invention

Laundry hampers and baskets have been in use for some time. It is often desirable to use such hampers and baskets, not only to store soiled garments prior to laundering them, but also to transport soiled garments to washing and drying machines, which may be located in another part of the residence in which the garments are stored, or outside the residence in a shared laundry room, a laundromat or other location, and to return the cleaned and laundered garments to the residence, or to another part of the residence.

While prior art laundry hampers and baskets may include some form of handle to facilitate their transport, they are often cumbersome to carry about. In particular, many prior art hampers and baskets tend to be relatively large in size, and can become heavily laden with soiled garments awaiting washing. Inasmuch as the carrying handles of prior art hampers and baskets are typically spaced on two opposing sides of the container, they can be spaced relatively far apart, making the container quite difficult to carry when having to grasp handles that are spaced far apart. Moreover, the relatively large external dimensions of many prior art hampers and baskets can make them physically cumbersome to transport, such as when carrying them through relatively narrow doors and passageways.

Accordingly, it an object of the present invention to provide laundry hampers and baskets that are easy to transport, even when heavily laden with garments or other objects.

It is another object of the present invention to provide laundry hampers and baskets that transition to the configuration of a tote bag under manual operation to facilitate their transport.

It is another object of the present invention to provide laundry hampers and baskets that automatically transition from a tote bag configuration back to a laundry hamper or basket configuration to facilitate their use as a hamper or basket while stationary.

These and other objects and features of the present invention will become apparent in view of the following specification, drawings and claims.

BRIEF SUMMARY OF THE INVENTION

This present invention a unit that, while in a stationary and undisturbed condition (apart from being filled with laundry or other articles), appears to be rigid to correspond with the consumer's conventional image of what a laundry hamper or basket looks like. However, due to the incorporation of resilient members on two side panels of the hamper or basket, the consumer can bring the front and rear panels of the container in closer proximity, such as during transport, thereby causing the side panels to bow outwardly in a curved fashion, making the unit look and act more like a bag or tote, with greater portability. As a bag or tote, the unit can be readily held with one hand and carried around.

The front and rear panels may be brought into proximity to convert the unit to a tote configuration by drawing together two opposing handles, each associated with a front or rear panel. Upon releasing the handles or otherwise ceasing to draw together the front and rear panels, the side panels cease to bow outwardly, and return to a substantially planar configuration. Accordingly, the unit automatically reverts to its default, hamper-like or basket-line configuration when not physically prompted into the tote configuration by the consumer/user.

One of the benefits of this convertibility is that the unit serves two purposes with no consumer assembly required. The invention, in a preferred embodiment, has front, rear, left and right panels that are substantially trapezoidal in shape, and a bottom panel and top opening that are substantially rectangular in shape. Internal frame members associated with the unit serve to stretch the outer shell of the unit, which is preferably constructed of a fabric material, relatively taut. The frame members include portions that are rigid, formed of metal wire or other suitable material (associated with the front, rear and bottom panels), as well as two portions that are resilient, formed of coil metal springs, resilient plastic tubing, or other suitable material (associated with the left and right panels).

In one embodiment, two trapezoidal front and rear wire frame portions are welded or otherwise coupled to a rectangular wire bottom frame portion. In another embodiment, the two trapezoidal front and rear wire frame portions are connected to, or are biased to remain adjacent, a rectangular bottom frame portion constructed of paperboard or other suitable rigid material, forming the bottom portion of the frame. In both embodiments, the four sides and bottom of the unit are covered in a nylon fabric or other suitable flexible material.

Metal coil springs or other resilient members are inserted horizontally into channels that are sewn or otherwise created proximate to top edges of the left and right panels of the unit. These resilient members form the remainder of the unit's overall frame. Specifically, the left side panel and right side panel are likewise stretched relatively tautly across the resilient members and the remainder of the frame (i.e., the wire portions and paperboard portions, if present in the particular embodiment). However, the resilient members are not coupled directly to the wire portions of the frame. Rather, the resilient members are held in place within relatively strong fabric channels sewn into or otherwise attached to the top portions of the left and right fabric sides of the hamper. In embodiments where coil springs are employed as the resilient members, they are preferably capped at their ends to inhibit their ends from abrading or otherwise damaging adjacent fabric of the unit.

When these resilient members are at rest and have not been flexed as a result of the front and rear panels of the unit being drawn towards each other, they remain substantially linear, and provide sufficient rigidity to the left and right side panels of the unit, comparable or similar to the rigidity provided by a wire or other rigid material.

The unit preferably includes two opposing, flexible handles, disposed at the top regions of the front and rear panels of the unit. In a preferred embodiment, the handles are each constructed of a loop of fabric, and are attached to a strong, reinforced frame portion about the circumferential top opening of the unit. This reinforced portion may comprise an additional fabric strip stitched to or otherwise adhered to the outer fabric of the unit, or may comprise upper flaps of the various fabric panels of the unit, that are folded back over upon the respective panels in order to provide a double-thickness fabric region, and then sewn or otherwise adhered to the adjacent region of the respective panel.

Although, in a preferred embodiment, the handles are constructed of a flexible material such as woven nylon, they may alternatively be constructed of a rigid material, such as plastic or metal, and may optionally be pivotably coupled to their respective panels of the container.

When users grasp the handles and draw them together, the resilient members proximate the top edges of the left and right side panels flex within their respective channels and bow outwards in a curved or arcuate manner, as the front and rear panels, and their associated frame members, particularly their respective top portions, are drawn closer together. This, in turn, causes the configuration of the unit to transition or convert from a hamper-shaped or basket-shaped configuration to a tote-shaped configuration, making it easier for the user to carry the unit on one side of their body. This flexing of the flexible members creates spout-shaped configurations of the left and right side panels, the overall effect being that the unit takes on the appearance and configuration of a traditional tote bag, which is more attractive and fashionable to carry than a conventional hamper.

Resilient materials other than metal springs which likewise bend and flex can be used in place of the metal springs, including, but not limited to, curved metal plates, plastics and fabrics with heavy backing, and bendable and resilient plastic tubing. Materials other than metal wire which are also rigid may alternatively be used in place of the metal wire to create the remainder of the frame, including, but not limited to, plastics and paperboard.

As a result of its trapezoidal front, rear, left and right panels, with a top opening that is larger in area its bottom panel, the units are stackable by being nested one inside of the other. When nested on a retailer's shelf, the merchandising of the unit is optimized by this configuration, facilitating a "grab and go" purchase by the consumer.

In alternative embodiments, the relative dimensions of the panels may be modified, such that the front and rear panels are smaller in dimension that the left and right panels. This, in turn, creates units that, in the tote configuration, have larger spout-shaped or bowed ends.

DETAILED DESCRIPTION OF THE INVENTION

Figure 1:
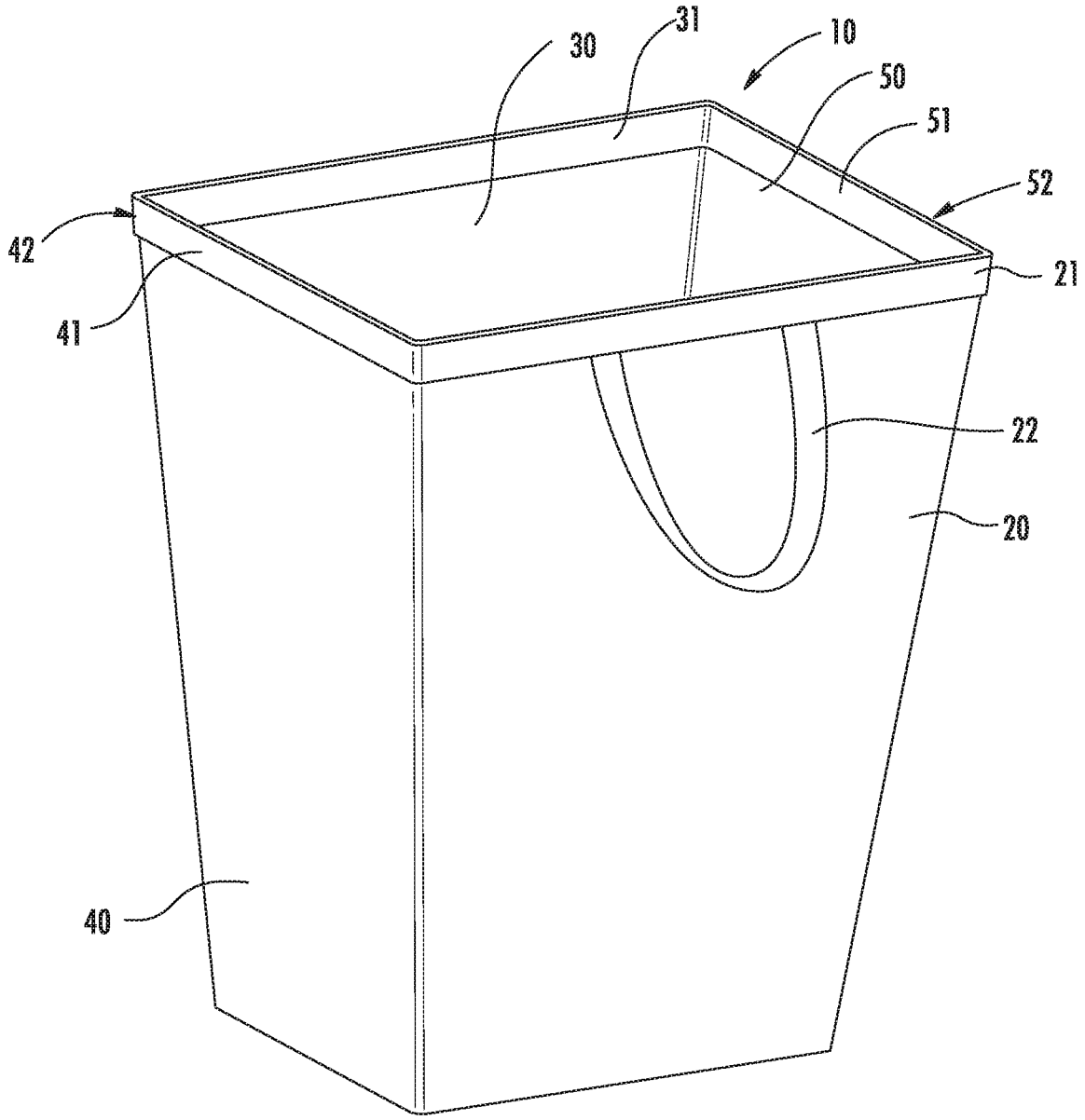
FIG. 1 is an elevated perspective view of the present invention, shown in the hamper configuration.

While the present invention is susceptible of embodiment in many different forms, there is shown in the drawings and will herein be described in detail, several specific embodiments, with the understanding that the present disclosure is intended as an exemplification of the principles of the present invention and is not intended to limit the invention to the embodiments illustrated.

An embodiment of the present container, in the form of a shape shifting hamper and bag 10, is shown in FIGS. 1-7 as comprising front panel 20, rear panel 30, left panel 40 (also referred to herein as first side panel 40), right panel 50 (also referred to herein as second side panel 50), and bottom panel 60. Each panel is preferably constructed of a relatively sturdy, natural or synthetic fabric material, such as nylon, and surrounds an associated frame 100. Frame 100 supports the fabric panels and comprises trapezoidal front portion 120, trapezoidal rear portion 130, left resilient member 140, right resilient member 150, and bottom stiffener 160. Trapezoidal front portion 120 and trapezoidal rear portion 130 are preferably constructed of a rigid metal wire material, such as steel wire.

Figure 6:
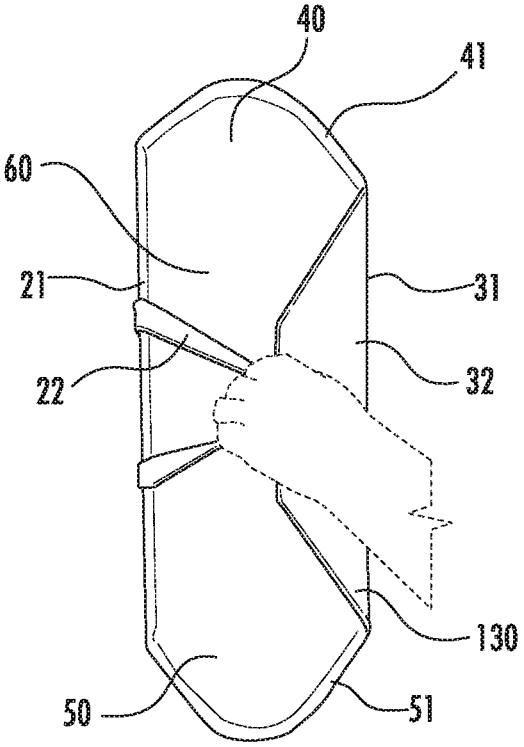
FIG. 6 is a top plan view of the present invention, shown with the handles grasped together and in the tote bag configuration.

As best seen in FIG. 6, the top crossbars of trapezoidal front portion 120 and trapezoidal rear portion 130 of frame 100 are disposed and retained within reinforced upper regions 21 and 31 of front panel 20 and rear panel 30, respectively. These reinforced upper regions may be constructed, for example, by folding extended top material of front panel 20 and rear panel 30 inwardly, about the top crossbars of trapezoidal front portion 120 and trapezoidal rear portion 130, and then stitching or otherwise attaching the extended top material to the interior of the overall adjacent panel to create a double-thickness region. This, in turn, creates longitudinal channels within the double-thickness regions in which the frame's top crossbars are securely retained.

Figure 2:
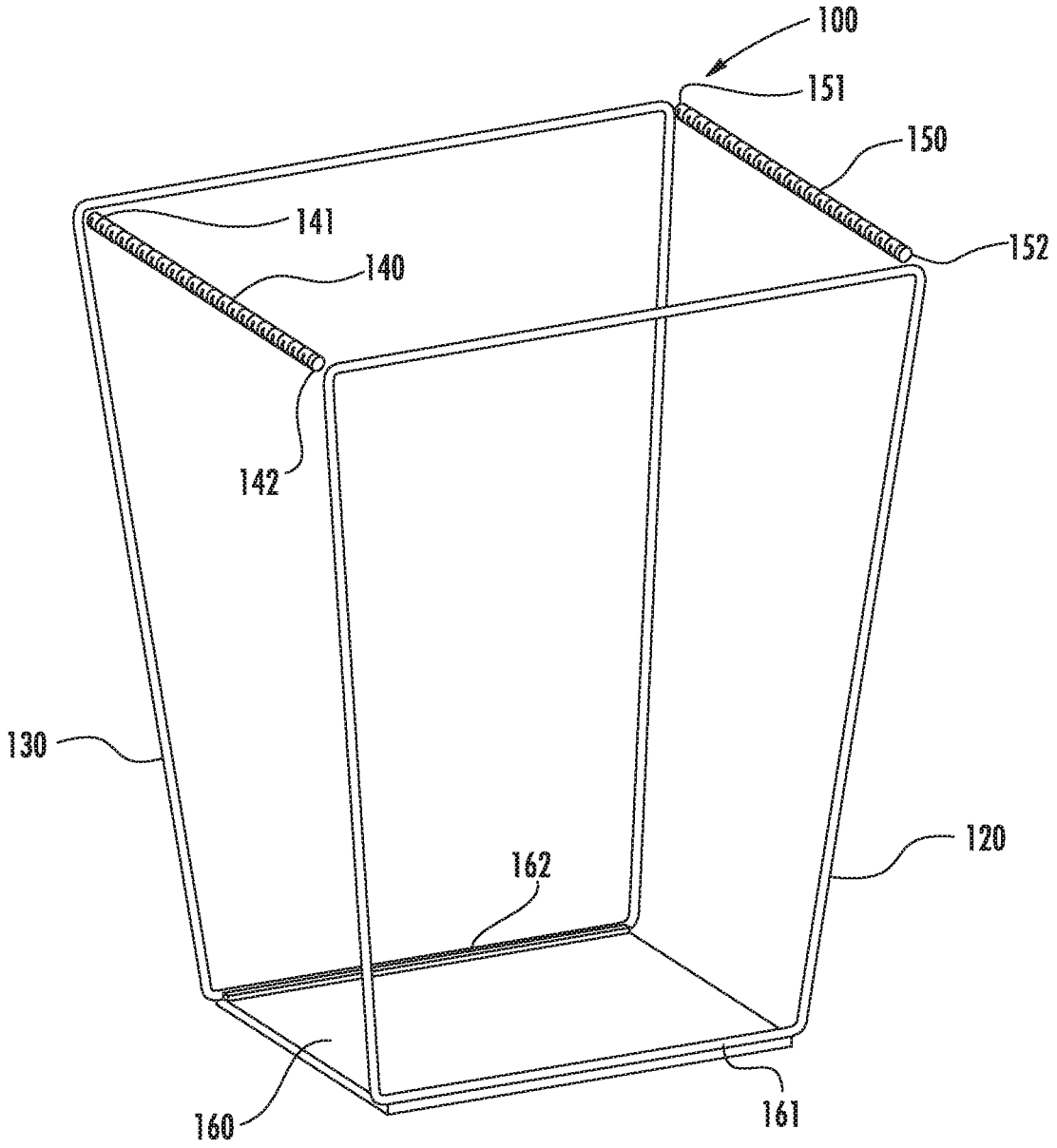
FIG. 2 is an elevated, perspective view of the frame of the present invention, shown in the hamper configuration.
Figure 3:
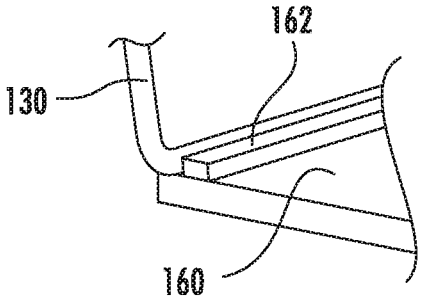
FIG. 3 is a detailed view of a portion of a bottom corner of the frame of the present invention.
Figure 4:
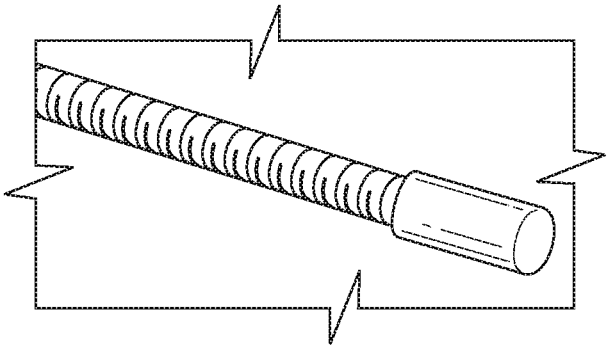
FIG. 4 is a detailed view of a coil spring and associated end cap of the frame of the present invention.

As shown in FIGS. 2 and 3, bottom stiffener 160 includes two opposing longitudinal retaining risers 161, 162, each extending parallel to and adjacent an associated bottom crossbar of trapezoidal front portion 120 and trapezoidal rear portion 130, respectively. These retaining risers 161, 162 are rectangular cuboid in shape, and may be constructed, for example, of a resilient material such as a resilient foam material. Retaining risers 161, 162 each serve to create an associated longitudinal channel, running between a longitudinal surface of retaining riser 161, 162 and an adjacent lower surface of front panel 20 and rear panel 30, respectively. These channels, in turn, retain an associated, adjacent bottom crossbar of trapezoidal front portion 120 and trapezoidal rear portion 130 in an opposing, spaced relationship proximate opposing sides of bottom stiffener 160. Moreover, the resilient nature of retaining risers 161, 162 cause these channels to retain the bottom crossbars of trapezoidal front portion 120 and trapezoidal rear portion 130 in a manner that permits the crossbars to rotate therein about their longitudinal axes. This rotation of the bottom crossbars of trapezoidal front portion 120 and trapezoidal rear portion 130, in turn, permits a limited degree of rotation of front panel 20 and rear panel 30 about respective axes proximate bottom stiffener 160, facilitating the ability of the upper regions of front panel 20 and rear panel 30 to be drawn towards each other, in the manner described above, such as by drawing handles 22 and 32 together.

The bottom crossbars of trapezoidal front portion 120 and trapezoidal rear portion 130, and/or the vertical upright bars of these frame portions, may alternatively be directly attached to their adjacent front or rear panels, such as by stitching additional fabric material of front panel 20 and rear panel 30 to the interior of the container 10 to create longitudinal frame retaining channels.

As shown in FIG. 2, left resilient member 140 and right resilient member 150, which may each be constructed, for example, of a helical coil steel spring, and their associated protective end caps 141, 142, 151 and 152, which may each be constructed, for example, of a plastic material or rubber compound, are preferably not directly attached or coupled to the remainder of frame 100. Rather, left resilient member 140 and right resilient member 150 are each held in place within longitudinal channels 42, 52 of reinforced upper regions 41, 51 of left panel 40 and right panel 50, respectively. Reinforced regions 41 and 51 may be constructed, for example, by folding extended top material of left panel 40 and right panel 50 inwardly, about the left resilient member 140 and right resilient member 150, respectively, and then stitching or otherwise attaching the extended top material to the interior of the overall adjacent panel. This, in turn, creates the longitudinal channels 42, 52 in which the resilient members and their end caps are securely retained, and, at the same time, creates double-thickness, strengthened and reinforced upper regions of left panel 40 and right panel 50.

As shown in FIGS. 1, 5, 6 and 7, the present shape shifting hamper and bag 10 further includes front handle 22 and rear handle 32. Each handle preferably comprises a loop of fabric material, which may be the same material from which the various panels of the container are constructed. In particular, front handle 22 is coupled at both of its opposing ends to reinforced upper region 21 of front panel 20. Rear handle 32 is likewise coupled at both of its opposing ends to reinforced upper region 31.

In operation, the present shape shifting hamper and bag is capable of changing its configuration back and forth between a static, resting configuration, wherein it takes on the shape of a laundry hamper, and a dynamic, carrying or transporting configuration, wherein it takes on the shape of a tote bag. As shown in FIG. 1, in its static, resting configuration, handles 22, 32 both hang down about the exterior of the container, left resilient member 150 and right resilient member are each substantially linear, and each of front panel 20, rear panel 30, left panel 40 and right panel 50 are substantially planar. Moreover, in the static configuration, the top regions of front panel 20 and rear panel 30 are spaced widely apart, and the container 10 has a substantially rectangular top opening. As a result, the shape shifting hamper and bag 10 in its static condition takes on the general configuration of a laundry hamper, and may be used, for example, to accumulate and store soiled garments prior to their laundering. As one can appreciate, the hamper configuration is quite convenient for accumulating and storing soiled garments awaiting laundering, as, among other things, it presents a large, accessible rectangular top opening for placing garments within the container. The large, accessible rectangular top opening of the hamper configuration is also quite convenient for returning cleaned or laundered garments back into the container for further transport.

Figure 5:
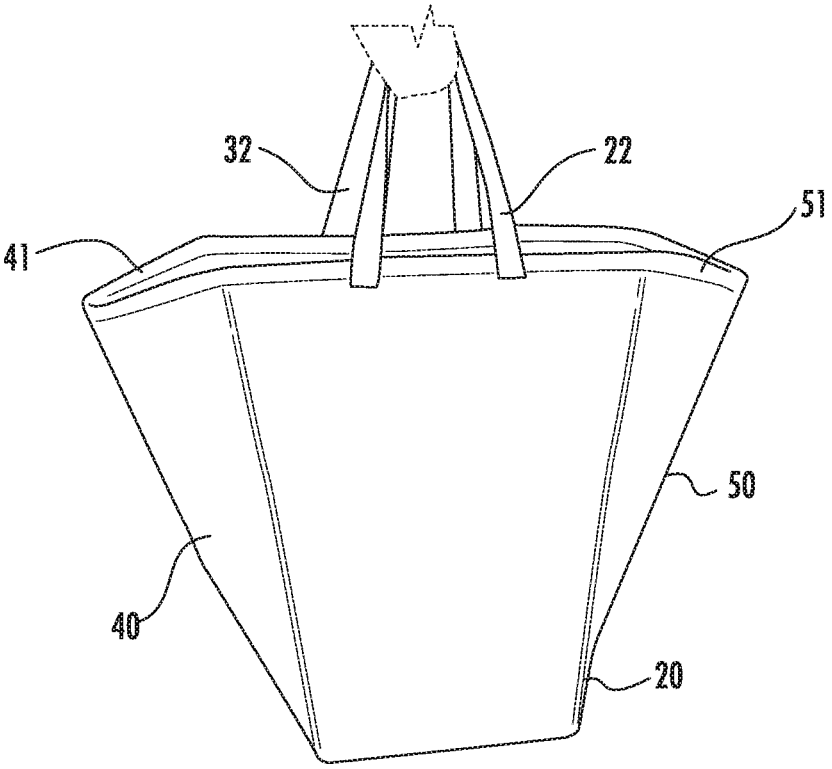
FIG. 5 is an elevated front view of the present invention, shown with the handles grasped together and in the tote bag configuration.
Figure 7:
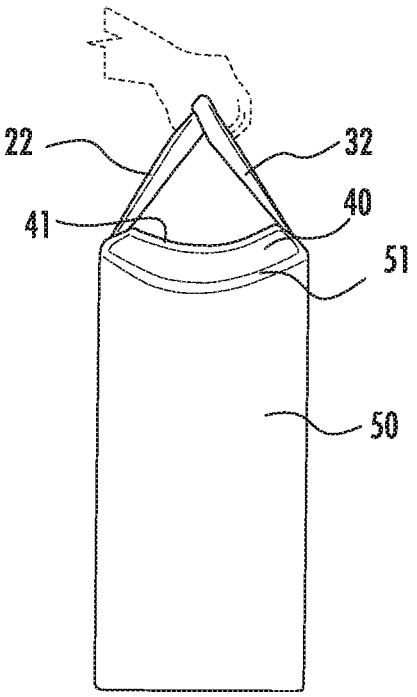
FIG. 7 is an elevated side view of the present invention, shown with the handles grasped together and in the tote bag configuration.

As shown in FIGS. 5, 6 and 7, when a user grasps handles 22 and 32, and draws the handles together in one hand in order to carry the shape shifting hamper and bag 10 about along one side of the user's body, the container transitions from its static hamper configuration to a dynamic tote bag configuration. In particular, drawing handles 22 and 32 together causes reinforced upper region 21 of front panel 20 and reinforced upper region 31 of rear panel 30 to likewise be drawn together. At the same time, drawing handles 22 and 32 together further causes top crossbars of trapezoidal front portion 120 and trapezoidal rear portion 130 of frame 100 to be drawn towards each other, and further causes each of trapezoidal front portion 120, trapezoidal rear portion 130, front panel 20, and rear panel 30 to be canted inwardly, towards the interior of the overall container.

Moreover, front panel 20 and rear panel 30 being drawn towards each other resultantly causes left resilient member 140 and right resilient member 150 to flex, and to transition from a substantially linear configuration to a curved, or arcuate configuration, bowing outwardly from the interior of overall container. This, in turn, causes left panel 40 and right panel 50 to transition from their substantially planar configuration to a substantially spout-shaped configuration, as best seen in FIG. 5.

Furthermore, front panel 20 and rear panel 30 being drawn towards each other additionally causes the top opening of the container to transition from a substantially rectangular configuration, as shown in FIG. 1, to a substantially canoe-shaped configuration (which may also be referred to as an elongated oval, or racetrack configuration), in which both the left panel and right panel bow outwards into spout-like configurations, as best seen in FIG. 6. As one can appreciate, the tote bag configuration to which the container has transitioned is quite convenient for transporting soiled garments and other objects previously placed into the container, as it creates a narrower (from the front to rear of the container) structure, making it more convenient to, among other things, pass through narrow doorways while transporting the container alongside one's body. The ability of the front and rear panels to be drawn more closely together also makes it more easy to grasp and transport the container and its handles in a single hand, which is far more ergonomic than using both hands simultaneously to transport the container.

Upon the user's releasing his or her grasp of handles 22 and 32, the container 10 automatically transitions from the dynamic tote bag configuration back to the static hamper configuration. In particular, at this time, front panel 20 and rear panel 30 are no longer drawn together or canted inwardly, and the top crossbars of trapezoidal front portion 120 and trapezoidal rear portion 130 of frame 100 are no longer drawn towards each other. Moreover, upon the user's releasing his or her grasp of handles 22 and 32, left resilient member 140 and right resilient member 150 transition back from their respective arcuate, outwardly bowed configuration back to their substantially linear configuration. This, in turn, permits left panel 40 and right panel 50 to transition back from their substantially spout-shaped configuration back to their substantially linear configuration.

At the same time, the top opening of the container transitions back from its substantially elongated oval or racetrack configuration to its substantially rectangular configuration. As the container is now back in the hamper configuration, the user may now more easily remove the contents of the container for laundering, or place new garments into the container so that they may be accumulated and stored for later laundering.

An alternative construction of a portion of the frame of the present shape shifting hamper and tote bag is shown in FIG.

Figure 8:
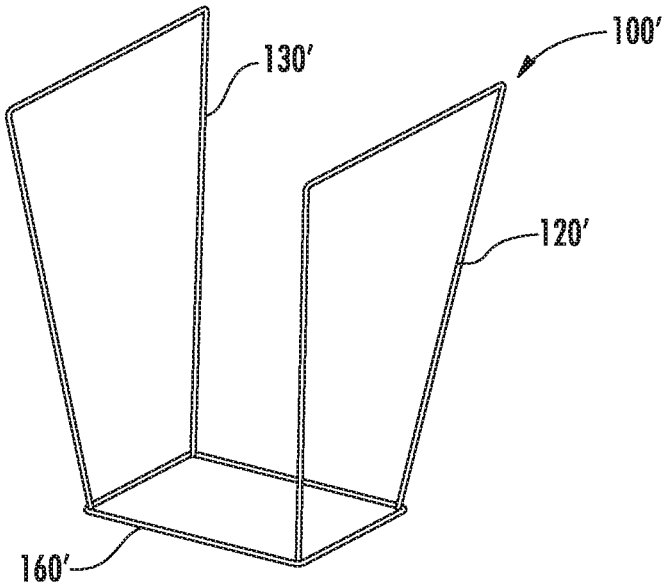
FIG. 8 is an elevated perspective view of a portion of the frame of an alternative embodiment of the present invention.

8. In particular, frame portion 100', which does not include the requisite resilient members, is shown in FIG. 8 as comprising trapezoidal front portion 120', trapezoidal rear portion 130', and rectangular bottom portion 160'. In this embodiment, rectangular bottom potion 160' is constructed of a rigid wire material, such as steel wire, and is welded or otherwise connected to trapezoidal front portion 120' and trapezoidal rear portion 130'. Notably, this alternative frame construction does not employ paperboard or other form of planar bottom stiffener, and eliminates the requirement for, among other things, the use of frame retaining risers (such as risers 161 and 162) to maintain the bottom regions of the front and rear frame members in a spaced relationship.

Although, in the previously described embodiments, the container transitions between laundry hamper and tote bag configurations, it is also contemplated that the container instead transition between laundry basket and tote bag configurations. Laundry baskets typically differ from laundry hampers primarily in their physical dimensions. Laundry hampers are, in general, relatively tall in height, and somewhat short in the horizontal dimensions of their front and rear panels, or surfaces. Laundry baskets are, in general, significantly shorter in height than laundry hampers, and significantly longer in the horizontal dimensions of their front and rear panels, or surfaces, creating an overall appearance that is more squat than that of laundry hampers. In this alternative embodiment having a static configuration of a laundry basket, each of front panel 20, rear panel 30, left panel 40 and rear panel 50 are significantly shorter in height, and both front panel 20 and rear panel 30 are significantly longer in their horizontal dimensions. Notably, grasping together the handles of this alternative embodiment still causes the container to transition to a tote bag configuration, although the tote bag is somewhat longer in the horizontal dimension and shorter in the vertical dimension than in the previously described embodiments. Otherwise, the construction of this embodiment is similar to those previously described. In this manner, embodiments of the invention may transition between laundry basket and tote bag configurations, rather than laundry hamper and tote bag configurations.

Although, in the previously described embodiments, two opposing resilient members associated with the left and right panels of the container are employed to permit the container to transition between a hamper/basket configuration and a tote bag configuration, other manners of construction of the side panels are also contemplated by the present invention. For example, the entire left and right panels of the container may, instead of being constructed of a fabric material, be constructed of a resilient sheet of material, such as a plastic material. In this alternative embodiment, the entire left and right panels are in a static, substantially planar orientation when the container is in its static, at rest, hamper/basket configuration. Moreover, the left and right panels flex and bow outwardly, taking on spout shaped configurations, when the front and back panels are drawn together (such as by drawing their associated handles together), and return to substantially planar configurations, when the front and back panels are released from being drawn together (such as by releasing their respective handles from being drawn together). In these embodiments, the requirement for separate, individual resilient members 140 and 150 are eliminated.

Although, in the previously described embodiments, both left panel 40 and right panel 50 include either resilient upper regions (such as by the inclusion of left resilient member 140 and right resilient member 150 within channel 42 and channel 52, respectively), or are constructed entirely of a resilient material, alternative embodiments are also contemplated by the present invention. In particular, it is also contemplated that only one of left panel 40 and right panel 50 include either a resilient upper region (in the manner described above), or is constructed entirely of a resilient material. In this embodiment, the other one of left panel 40 and right panel 50 is substantially rigid, and remains substantially planar upon the upper regions of front panel 20 and rear panel 30 being drawn towards each other, such as by drawing handles 22 and 32 together. The rigidity of left panel 40 or right panel 50 may be accomplished by placing a relatively rigid material such as paperboard within the panel, or adjacent the panel within the interior of the container. Alternatively, frame 100 may be modified to include a rigid upper crossbar, welded or otherwise affixed to trapezoidal front portion 120 or trapezoidal rear portion 130, in place of either left resilient member 140 or rear resilient member 150, in order to lend rigidity to left panel 40 or right panel 50. Moreover, either of left panel 40 or right panel 50 may alternatively be constructed of a relatively rigid material, such as rigid plastic, rather than a fabric material.

In this alternative embodiment, front panel 20 and rear panel 30 being drawn towards each other, such as by drawing together handles 22 and 32 together, causes only one of left panel 40 and right panel 50 to bow outwards, into a spout-like configuration, while the other panel remains substantially planar. Accordingly, in this embodiment, front panel 20 and rear panel 30 being drawn towards each other causes the top opening of the container to transition from a substantially rectangular configuration, as shown in FIG. 1, to a substantially rowboat-shaped configuration, as viewed from above the top opening of the container. As one can appreciate, this alternative tote bag configuration to which the container has transitioned is likewise convenient for transporting garments and other objects previously placed into the container, as it creates a narrower (from the front or rear of the container) structure.

Although the present invention is primarily intended for the transport of garments, other objects, such as groceries and other retail purchases, children's diapers and accessories, and toys, may alternatively, or additionally, be transported using the present invention.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of construction of the invention disclosed herein without departing from the spirit and scope of the invention. The present disclosure is intended to exemplify and not limit the invention.

What is claimed is:

1. A container for the storage and transporting of objects, comprising:

a rigid front panel having an upper region;

a rigid rear panel having an upper region;

a first side panel having a first, planar configuration and a second, spout-shaped configuration, the first side panel being coupled to a left side of the front panel and a left side of the rear panel, at least an upper region of the first side panel extending from proximate the front panel to proximate the rear panel having a first, linear configuration and a second, outwardly bowed configuration;

a first resilient member disposed proximate the upper region of the first side panel and extending from proximate the front panel to proximate the rear panel, the first resilient member having a first, linear configuration and a second, outwardly bowed configuration;

the upper region of the first side panel taking on its second, outwardly bowed configuration and the first resilient member taking on its second, outwardly bowed configuration upon at least one of the upper region of the front panel and the upper region of the rear panel being drawn towards the other;

the first resilient member returning to its first, linear configuration and causing the upper region of the first side panel to return to its first, linear configuration upon releasing at least one of the upper region of the front panel and the upper region of the rear panel from being drawn towards the other;

the first side panel taking on its second, spout shaped configuration upon at least one of the upper region of the front panel and the upper region of the rear panel being drawn towards the other; and the first resilient member causing the first side panel to return to its first, planar configuration upon releasing at least one of the upper region of the front panel and the upper region of the rear panel from being drawn towards the other.

2. The container according to claim 1, wherein the container further comprises a second side panel having a first, planar configuration and a second, spout-shaped configuration, the second side panel being coupled to a right side of the front panel and a right side of the rear panel, at least an upper region of the second side panel extending from proximate the front panel to proximate the rear panel being resilient and having a first, linear configuration and a second, outwardly bowed configuration;

a second resilient member disposed proximate the upper region of the second side panel and extending from proximate the front panel to proximate the rear panel, the second resilient member having a first, linear configuration and a second, outwardly bowed configuration;

the upper region of the second side panel taking on its second, outwardly bowed configuration and the second resilient member taking on its second, outwardly bowed configuration upon at least one of the upper region of the front panel and the upper region of the rear panel being drawn towards the other;

the second resilient member returning to its first, linear configuration and causing the upper region of the second side panel to return to its first, linear configuration upon releasing at least one of the upper region of the front panel and the upper region of the rear panel from being drawn towards the other;

the second side panel taking on its second, spout shaped configuration upon at least one of the upper region of the front panel and the upper region of the rear panel being drawn towards the other; and the second resilient member causing the second side panel to return to its first, planar configuration upon releasing at least one of the upper region of the front region of the front panel and the upper region of the rear panel from being drawn towards the other.

3. The container according to claim 1, further comprising:

a first handle operably coupled to the front panel;

a second handle operably coupled to the rear panel;

wherein drawing at least one of the first handle and the second handle towards the other causes the first resilient member to take on its second, outwardly bowed configuration, the first side panel to take on its second, spout-shaped configuration, and the upper region of the first side panel to take on its second, outwardly bowed configuration.

4. The container according to claim 2, further comprising:

a first handle operably coupled to the front panel;

a second handle operably coupled to the rear panel;

wherein drawing at least one of the first handle and the second handle towards the other causes the first resilient member to take on its second, outwardly bowed configuration, the first side panel to take on its second, spout-shaped configuration, the upper region of the first side panel to take on its second, outwardly bowed configuration, the second resilient member to take on its second, outwardly bowed configuration, the second side panel to take on its second, spout-shaped configuration, and the upper region of the second side panel to take on its second, outwardly bowed configuration; and wherein releasing at least one of the first handle and the second handle from being drawn towards the other causes the first resilient member to return to its first, linear configuration, the first side panel to return to its first, planar configuration, the upper region of the first side panel to return to its first, linear configuration, the second resilient member to return to its first, linear configuration, the second side panel to return to its first, planar configuration, and the upper region of the second side panel to return to its first, linear configuration.

5. The container according to claim 1, wherein the container takes on a tote bag configuration upon at least one of the upper region of the front panel and the upper region of the rear panel being drawn towards the other, and returns to a configuration of one of a hamper and a basket upon releasing at least one of the upper region of the front panel and the upper region of the rear panel from being drawn towards the other.

6. The container according to claim 3, wherein the container takes on a tote bag configuration upon at least one of drawing the first handle and the second handle towards the other, and returns to a configuration of one of a hamper and a basket upon releasing at least one of the first handle and the second handle from being drawn towards the other.

7. The container according to claim 2, wherein the container takes on a tote bag configuration upon at least one of the upper region of the front panel and the upper region of the rear panel being drawn towards the other, and returns to a configuration of one of a hamper and a basket upon releasing at least one of the upper region of the front panel and the upper region of the rear panel from being drawn towards the other.

8. The container according to claim 4, wherein the container takes on a tote bag configuration upon drawing at least one of the first handle and the second handle towards the other, and returns to a configuration of one of a hamper and a basket upon releasing at least one of the first handle and the second handle from being drawn towards the other.

9. The container according to claim 1, wherein the at least one resilient member comprises a coiled spring.

10. The container according to claim 1, wherein the at least one resilient member comprises plastic tubing.

11. The container according to claim 1, wherein at least one of the front panel, the rear panel, and the first side panel is constructed of a fabric material.

12. The container according to claim 1, wherein the container further comprises a frame.

13. The container according to claim 12, wherein at least a portion of the frame is constructed of a wire material.

14. The container according to claim 12, wherein at least a portion of the frame is constructed of paperboard.

15. The container according to claim 12, wherein the frame comprises the first resilient member.

16. The container according to claim 12, wherein the frame comprises the first resilient member and the second resilient member.

17. A container for the storage and transporting of objects, comprising:

a rigid front panel having an upper region having a linear configuration;

a rigid rear panel having an upper region having a linear configuration;

a first side panel having a first, planar configuration and a second, spout-shaped configuration, the first side panel being coupled to a left side of the front panel and a left side of the rear panel, at least an upper region of the first side panel extending from proximate the front panel to proximate the rear panel having a first, linear configuration and a second, outwardly bowed configuration;

a first resilient member disposed proximate the upper region of the first side panel and extending from proximate the front panel to proximate the rear panel, the first resilient member having a first, linear configuration and a second, outwardly bowed configuration;

the upper region of the first side panel taking on its second, outwardly bowed configuration, the first resilient member taking on its second, outwardly bowed configuration, the upper region of the rigid front panel retaining its linear configuration, and the upper region of the rigid rear panel retaining its linear configuration, upon at least one of the upper region of the front panel and the upper region of the rear panel being drawn towards the other;

the first resilient member returning to its first, linear configuration and causing the upper region of the first side panel to return to its first, linear configuration upon releasing at least one of the upper region of the front panel and the upper region of the rear panel from being drawn towards the other;

the first side panel taking on its second, spout shaped configuration upon at least one of the upper region of the front panel and the upper region of the rear panel being drawn towards the other; and the first resilient member causing the first side panel to return to its first, planar configuration upon releasing at least one of the upper region of the front panel and the upper region of the rear panel from being drawn towards the other.

* * * * *